US007465190B2

(12) United States Patent
Henningsen

(10) Patent No.: US 7,465,190 B2
(45) Date of Patent: Dec. 16, 2008

(54) COAXIAL CONNECTOR AND METHOD

(75) Inventor: Jimmy Ciesla Henningsen, Homegaard (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/478,756

(22) Filed: Jun. 29, 2006

(65) Prior Publication Data

US 2008/0003873 A1 Jan. 3, 2008

(51) Int. Cl.
*H01R 9/05* (2006.01)

(52) U.S. Cl. ..... 439/578; 439/583; 439/584; 439/320

(58) Field of Classification Search ..... 439/578, 439/583–585, 320
See application file for complete search history.

(56) References Cited

U.S. PATENT DOCUMENTS

| | | | | | |
|---|---|---|---|---|---|
| 3,538,487 | A | | 11/1970 | Lanham | 339/95 |
| 3,678,446 | A | | 7/1972 | Siebelist | 339/177 E |
| 3,757,279 | A | * | 9/1973 | Winston | 439/584 |
| 3,910,673 | A | * | 10/1975 | Stokes | 439/584 |
| 4,053,200 | A | * | 10/1977 | Pugner | 439/578 |
| 4,135,776 | A | * | 1/1979 | Ailawadhi et al. | 439/583 |
| 4,575,274 | A | * | 3/1986 | Hayward | 403/2 |
| 4,676,577 | A | | 6/1987 | Szegda | 439/584 |
| 4,952,174 | A | | 8/1990 | Sucht et al. | 439/584 |
| 5,795,188 | A | | 8/1998 | Harwath | 439/583 |
| 5,938,474 | A | * | 8/1999 | Nelson | 439/583 |
| 6,133,532 | A | | 10/2000 | Lundbäck et al. | 174/88 |
| 6,183,298 | B1 | | 2/2001 | Henningsen | 439/578 |
| 6,558,194 | B2 | * | 5/2003 | Montena | 439/585 |
| 6,891,512 | B2 | | 5/2005 | Chadwick | 343/773 |
| 6,955,562 | B1 | | 10/2005 | Henningsen | 439/578 |
| 7,029,304 | B2 | | 4/2006 | Montena | 439/320 |
| 7,029,326 | B2 | | 4/2006 | Montena | 439/585 |
| 7,048,579 | B2 | | 5/2006 | Montena | 439/578 |
| 2005/0118865 | A1 | | 6/2005 | Henningsen | 439/578 |

* cited by examiner

*Primary Examiner*—Tho D. Ta
*Assistant Examiner*—Travis Chambers
(74) *Attorney, Agent, or Firm*—Joseph M. Homa; Matthew J. Mason

(57) ABSTRACT

Coaxial connectors for coaxial cable and methods for connecting coaxial connectors to a coaxial cable include: a sleeve for allowing passage of a prepared end of a coaxial cable therethrough having at least a first contact surface, a terminal including a second contact surface, an insulator disposed therein for receiving a center conductor of a coaxial cable and a nut for receiving the sleeve, the nut being axially displaceable along at least a portion of the sleeve. The first and second contact surfaces form a clamping region for capturing the outer conductor of a coaxial cable. The coaxial connector does not include a center conductor. An insulator is disposed in the terminal to receive the inner conductor of a coaxial cable for direct connection to a junction box, amplifier, or other coaxial port.

19 Claims, 2 Drawing Sheets

COAXIAL CONNECTOR AND METHOD

BACKGROUND OF THE INVENTION

The present invention relates in general to coaxial connectors and more particularly to a simplified coaxial connector and method of attachment of a cable to the coaxial connector.

Hardline coaxial cables are widely used in the cable television industry to distribute cable television signals and include a central inner conductor surrounded by a low loss, high dielectric plastic foam. The foam dielectric is, in turn, surrounded by a metallic outer conductor which may be smoothly cylindrical or corrugated. A protective insulating jacket surrounds the metallic outer conductor and helps prevent moisture from degrading the signal path. The ends of such coaxial cables are connected to junction boxes, amplifiers, and other coaxial ports. Coaxial connectors are well known for terminating the ends of hardline coaxial cables.

In order to properly transmit an electrical signal, a coaxial connector should ensure that a reliable electrical connection is achieved between the outer body of the connector and the outer conductor of the coaxial cable. Likewise, a suitable coaxial connector must achieve a reliable electrical connection between the center conductor of the connector and the inner conductor of the coaxial cable. In addition, reliable coaxial connectors must form a secure mechanical connection to the end of the coaxial cable, otherwise there is a risk of interference with successful transmission of the desired electrical signal.

Coaxial connectors are known which achieve secure electrical and mechanical coupling with the end of a coaxial cable. However, the complexity of such connectors, their relatively high parts count, and the burden imposed upon the technician during installation, are all significant drawbacks to currently known connectors. Current coaxial connectors in many instances require soldering to provide a secure connection.

Other current hardline coaxial cable connectors on the market consist of a number of moving parts, typically a standard front end which includes an inner terminal or center conductor, an outer terminal or outer body, a dielectric insulator for supporting the center conductor within the outer body, and a moveable back nut which encapsulates a number of seals, retaining rings and the like. U.S. Pat. No. 6,133,532 shows one such connector having a back nut which encapsulates three different moving parts (a locking device, guide surface and inner sleeve) as well as three separate O-ring seals. The large number of moving parts in the back nut portion complicates the fitting of a coaxial cable which usually requires the use of several specialized tools. Additionally, the risk of connector malfunctioning and mounting problems increases with a higher number of moving parts, since there is a greater chance that at least one part may be defective, missing or incorrectly attached.

Likewise, U.S. Pat. No. 4,952,174 to Sucht, et al. discloses a coaxial connector wherein the back nut houses a cone, a mandrel, a mandrel shell, a tined ferrule, and a seal ring. The cone operates together with the center conductor of the connector to bite into the inner conductor of the coaxial cable. The tined ferrule bites into the outer surface of the outer conductor of the coaxial cable and forces such outer conductor against the mandrel. Apart from the relatively large number of parts, there is no direct contact between the outer conductor of the coaxial cable and the outer body of the connector.

U.S. Pat. No. 4,676,577 to Szegda discloses a coaxial connector for use with hardline coaxial cable and including a front body, a center conductor supported within the front body and insulated therefrom, and a rear nut (or cap body). The center conductor of the front body includes a collet for receiving the inner conductor of the coaxial cable. An insulative seizure bushing is positioned within the front body to constrict the collet when the seizure bushing is axially displaced. The front body also includes a mandrel for being inserted into the coaxial cable just inside the outer conductor thereof; this mandrel is axially movable relative to the front body and engages the seizure bushing. The rear nut includes an outer conductor clamp member for gripping the outer surface of the coaxial cable outer conductor, as well as a clamp ring having a ramped surface and engaging an o-ring. As the rear nut is tightened onto the front body, the outer conductor clamp member engages a ramp on the front body causing the outer conductor clamp member to be radially compressed inwardly against the outer conductor of the coaxial cable; likewise, the outer conductor clamp member engages the ramped surface of the clamp ring, again forcing the outer conductor clamp member to be compressed against the outer conductor of the coaxial cable, while compressing the o-ring within the rear nut. Simultaneously, the outer conductor clamp member engages, and axially displaces, the mandrel and seizure bushing within the front body to constrict the center conductor collet.

U.S. Pat. No. 6,183,298 to Henningsen also discloses a hardline coaxial connector having a main body, a bushing or back nut, a center conductor, and an insulator supporting the center conductor within the main body. The Henningsen '298 patent includes an axially displaceable member for radially compressing the center conductor of the connector about the inner conductor of the cable. However, the back nut, or bushing, again contains additional movable parts, including a slotted ferrule, an inner bushing; and a friction reducing disk.

U.S. Pat. Nos. 7,029,326 and 7,048,579 to Montena disclose a coaxial cable compression connector including a connector body, a tubular post, a compression member and a floating, deformable compression ring member. These patents also require several movable parts to achieve their intended purpose.

U.S. Pat. No. 7,029,304 discloses a cable connector including a front body adapted to connect to an equipment port, a back body adapted to receive a prepared end of a hardline coaxial cable, a coupler nut retained on the back body which screws into the front body, a conductive pin retained in the front body by an insulator, the conductive pin including a collet for connecting to and retaining a center conductor of the cable, and a mandrel retained in the back body. A conductive pin is required in this connector.

Due to the large number of moving parts encapsulated in the back nut of most conventional hardline connectors, the outer conductor ought to be thoroughly cleared of all glue and adhesive material that may hinder or jam the parts during mounting and tightening, or a poor electrical connection may result. This process can prove to be quite difficult and time-consuming.

The manufacture and assembly of conventional connectors is also expensive in terms of time taken and material costs due to the number of parts enclosed in the back nut, which have to be manufactured and assembled.

SUMMARY OF THE INVENTION

Briefly described, and in accordance with at least one embodiment thereof, the present invention provides a connector having a sleeve, a terminal, a nut and an insulator.

In one embodiment a hardline coaxial connector includes a sleeve for allowing passage of a prepared end of a coaxial cable therethrough having at least a first contact surface, a terminal having a bore, a stepped outer surface having a first outer diameter commensurate with an inner diameter of said sleeve, front and back opposing ends, the back end of the terminal including at least a second contact surface, the stepped outer surface forming a shoulder between the front and back ends and an insulator disposed therein, and a nut having a bore for receiving the sleeve, the nut being axially displaceable along at least a portion of the sleeve. The first and second contact surfaces form a clamping region for capturing the outer conductor of a coaxial cable.

The coaxial connector does not include a center conductor. Rather, an insulator is disposed in the terminal to receive the inner conductor of a coaxial cable for direct connection to a junction box, amplifiers, or other coaxial port. In this way the present coaxial connector accommodates the inner conductor of the coaxial cable to be connected, minimizing the amount of loss from the cable end to the female interface, reducing the number of parts in the connector, requiring only a single contact between the connector and the cable and only a single insulator in the connector. Structures in accordance with the present invention also eliminate what in many cases is the most expensive part of conventional coaxial connectors, i.e., the center conductor. Due to the care with which the center conductor must be constructed in conventional coaxial connectors, owing to the impact the outer diameter of the center conductor has on impedance performance which translates to return loss performance, elimination of the center conductor in the present invention reduces the cost and complexity involved in the manufacture and/or installation of the connector.

It will be apparent to those having skill in the art more than one insulator may be employed.

Apparatus in accordance with the embodiments of the present invention are simple and facilitate easy connection, while greatly reducing the chances of errors and defects in assembly and mounting in comparison to conventional connectors.

The connectors of the present invention are adapted to accommodate either corrugated or smooth coaxial cable.

In one embodiment the connector is adapted to accommodate coaxial cable having an inner conductor with a diameter of about 5 mm plus or minus 0.02 mm, a dielectric and an outer conductor selected to achieve approximately 50 ohm impedance. In one embodiment the coaxial cable is smooth and has an outer diameter of about 0.54 inches such as but not limited to 540 CellReach™ cable.

When practicing at least one mode of the invention, an outwardly-flared lip is formed on the exposed end of the outer conductor of the coaxial cable. In one embodiment the first contact surface in the clamping region is formed within the bore of the sleeve and is a radially inward annular step which engages the outer surface of such flared lip; optionally, the radially inward annular step includes a beveled surface for engaging the outer surface of such flared lip. The second contact surface in the clamping region is formed proximate a leading edge of the back end of the terminal and preferably is angled and/or tapered for entering within the flared lip of the outer conductor of the coaxial cable, thereby engaging the inner surface, thereof. The flared lip is clamped between such first and second contact surfaces as the terminal and sleeve are urged together.

In one embodiment the front end of the sleeve is compression fit to the back end of the terminal, with the first contact surface and second contact surface forming a clamping region for receiving a portion of the outer terminal of a coaxial cable. In one embodiment, the outer conductor of the coaxial cable is clamped in place at least in part as a result of the fit between the sleeve and terminal, and optionally further secured as the nut is axially displaced with respect to said sleeve.

In accordance with at least one embodiment, the sleeve includes a radially inward retaining lip at or near its front end and the outer surface of the terminal includes a complementary retaining groove proximate the shoulder for receiving the radially inward retaining lip of the sleeve. As the terminal is inserted into the sleeve, the retaining lip of the sleeve ultimately engages the retaining groove of the terminal to provide a secure, locked engagement. In one embodiment the terminal and sleeve fit together by way of a compression fit. The clamping region of the connector engages the outer conductor of the coaxial cable as the contact surfaces are urged toward each other.

In accordance with an alternate embodiment, the front end of the sleeve may further include a radially outward flange that is captured by the inner surface of the nut as the nut is axially displaced. Alternatively, the front end of the sleeve may include the radially outward flange and not include the retaining lip.

In one embodiment the nut includes at least one threaded portion adapted to engage a coaxial port. In accordance with another embodiment, any gap between the contact surfaces of the clamping region decreases as the nut is axially displaced toward a front end of the terminal.

According to one embodiment of the present invention, a procedure for mounting the coaxial connector to the end of the coaxial cable includes the steps of inserting the nut on the sleeve, removing a portion of the insulating jacket from the end of the cable which is to be connected, thereby exposing an end portion of the outer conductor of the coaxial cable; removing a portion of the outer conductor and dielectric material from the end of the cable to be connected to expose an end portion of the inner conductor thereof; inserting the prepared end of the cable into the sleeve, and securing same, preferably by way of a compression fit; flaring the end of the outer conductor of the coaxial cable; inserting the terminal into the sleeve such that the inner conductor of the cable is received in a bore of insulation disposed within the terminal and such that the flared end of the outer conductor is oriented in a gap formed between opposing contact surfaces of the terminal and sleeve forming a clamping region, and, depending on the embodiment, may be clamped in place as the retaining lip of the sleeve engages the retaining groove of the terminal and/or as the nut is axially displaced toward the front end of the terminal; and axially displacing the nut toward the front end of the terminal of the coaxial connector.

Other aspects, features, advantages, etc. will become apparent to one skilled in the art when the description of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION OF THE PRESENT INVENTION

Figure 1:
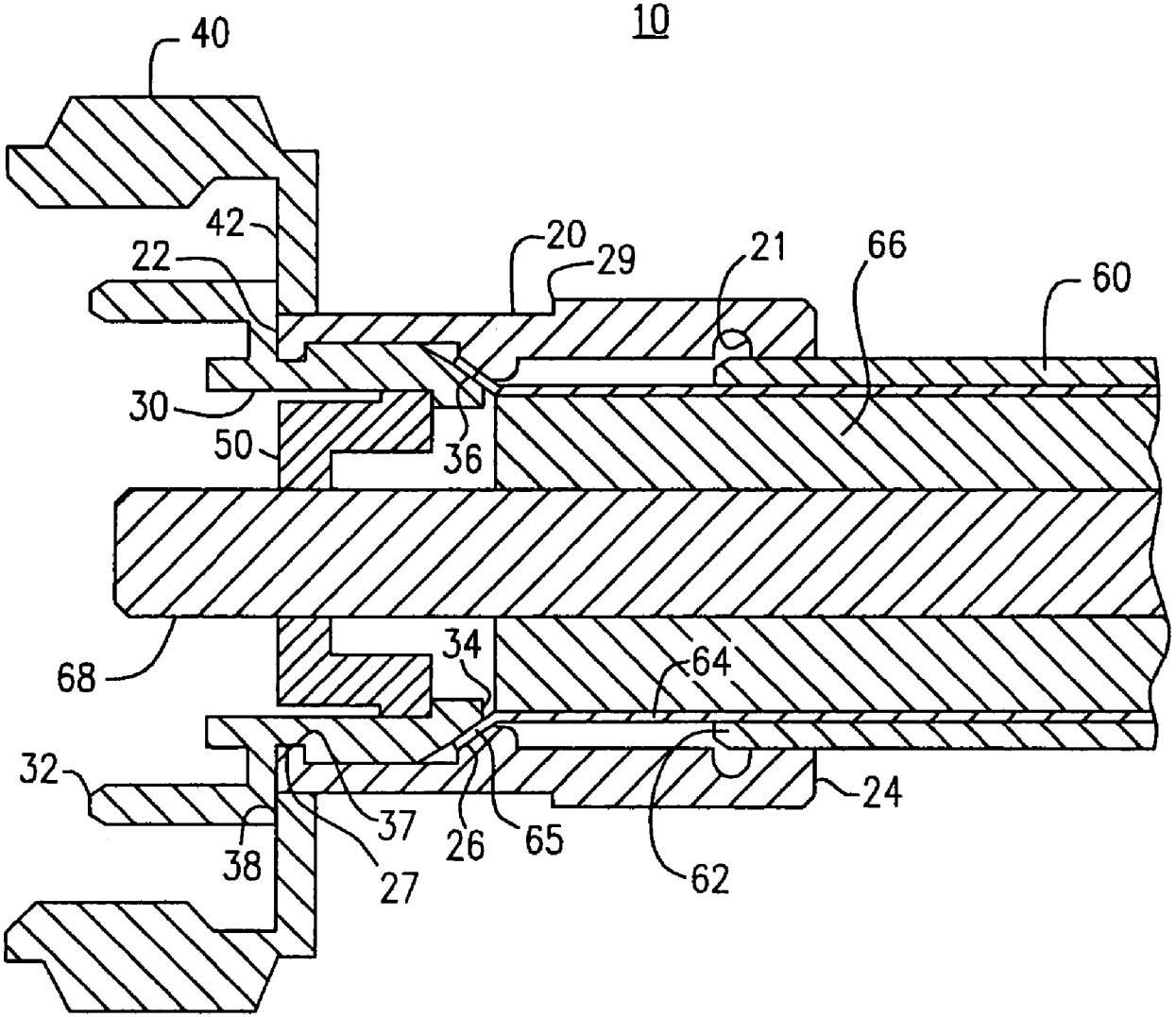
FIG. 1 is a sectional view of a coaxial connector device in accordance with one or more embodiments of the present invention.

With reference to the drawings, wherein like numerals indicate like elements, there is shown in FIG. 1 a coaxial connector 10 having a sleeve 20, a terminal 30, a nut 40 and an insulator 50.

In accordance with at least one embodiment sleeve 20 further includes a central bore for allowing passage of a prepared end of a coaxial cable 60 therethrough, and having a front end 22 and a back end 24 and a first contact surface 26. In one embodiment sleeve 20 further includes a radially inward lip 27. Sleeve 20 may further have at least one radial groove 21 for accommodating an O-ring.

In one embodiment terminal 30 includes a central bore, a stepped outer surface having a first outer diameter commensurate with an inner diameter of the sleeve 20, front and back opposing ends 32 and 34, respectively, the back end 34 of the terminal 30 including at least a second contact surface 36, the stepped outer surface forming a shoulder 38 between the front and back ends 32 and 34. In one embodiment terminal 30 further includes a groove 37 disposed on its outer surface.

Nut 40 includes a central bore and is axially displaceable along at least a portion of the sleeve 20. In one embodiment a stop 29 is disposed on the outer surface of sleeve 20 to impede axial movement of nut 40 toward the back end 24 of sleeve 20. In one embodiment nut 40 includes threads (not shown) for engaging a coaxial port (not shown).

Insulator 50 includes a central bore for receiving a center conductor 68 of a coaxial cable 60 and is disposed in the central bore of terminal 30. Insulator 50 serves as both a guide and support for center conductor 68. It will be apparent to those having skill in the art more than one insulator 50 may be employed.

Back end 24 of sleeve 20 receives a coaxial cable 60 and in one embodiment includes a bore having at least in part an inside diameter sufficient to achieve a press fit between the outer jacket 62 of coaxial cable 60 and inner surface of sleeve 20. In one embodiment, nut 40 is placed on sleeve 20 prior to insertion of the prepared end of the cable 60.

The front end 22 of sleeve 20 receives the back end of terminal 30. The first contact surface 26 and second contact surface 36 form a clamping region therebetween for capturing and compressing the outer conductor 64 of a coaxial cable.

In accordance with at least one mode of the invention, an outwardly-flared lip 65 is formed on the exposed end of the outer conductor 64 of the coaxial cable 60. In one embodiment the first contact surface 26 in the clamping region is formed within the bore of the sleeve 20 and is a radially inward annular step which engages the outer surface of the flared lip 65; optionally, the radially inward annular step includes a beveled surface for engaging the outer surface of such flared lip 65. The second contact surface 36 in the clamping region is formed proximate a leading edge of the back end 34 of the terminal 30 and preferably is angled and/or tapered for entering within the flared lip 65 of the outer conductor 64 of the coaxial cable 60, thereby engaging the inner surface of the flared lip 65. The flared lip 65 is clamped between such first and second contact surfaces 26 and 36 as the terminal 30 and sleeve 20 are urged together.

In one embodiment the front end 22 of the sleeve 20 is compression fit to the back end 34 of the terminal 30, with the first contact surface 26 and second contact surface 36 forming a clamping region for receiving a portion of the outer conductor 64 of a coaxial cable 60. In one embodiment, the outer conductor 64 of the coaxial cable 60 is clamped in place at least in part as a result of the fit between the sleeve 20 and terminal 30, and optionally further secured as the nut 40 is axially displaced with respect to said sleeve 20.

In accordance with at least one embodiment, the sleeve 20 includes a radially inward retaining lip 27 at or near its front end 22 and the outer surface of the terminal 30 includes a complementary retaining groove 37 proximate the shoulder 38 for receiving the radially inward retaining lip 27 of the sleeve 20. As the terminal 30 is inserted into the sleeve 20, the retaining lip 27 of the sleeve ultimately engages the retaining groove 37 of the terminal 30 to provide a secure, locked engagement. The clamping region of the connector 10 engages the flared lip 65 of the outer conductor 64 of the coaxial cable as the contact surfaces 26 and 36 are urged toward each other. In this embodiment further securement may be provided as the nut 40 is axially displaced with respect to said sleeve 20.

Figure 2:
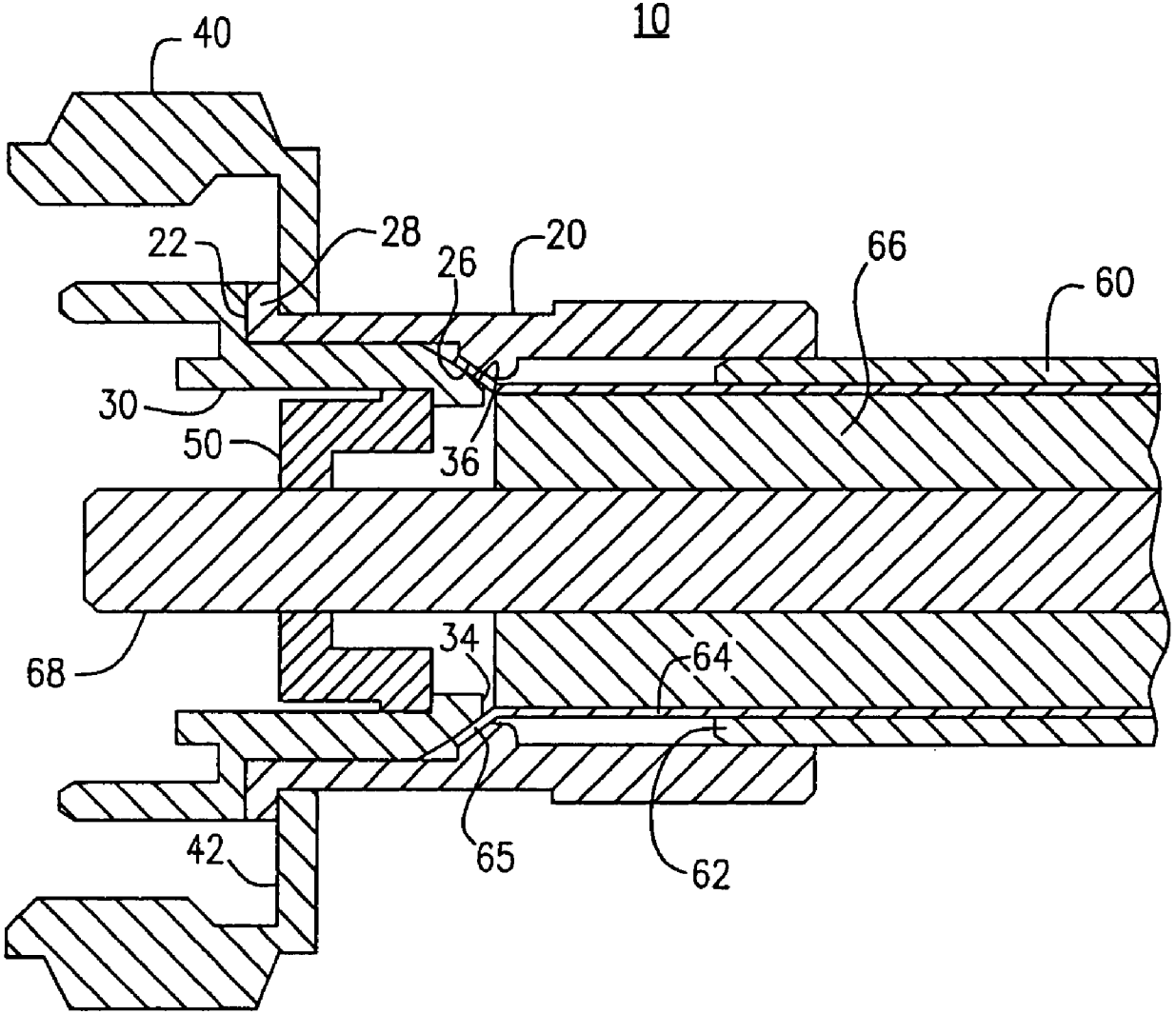
FIG. 2 is a sectional view of a coaxial connector device in accordance with one or more embodiments of the present invention.

Now referring to FIG. 2, in accordance with an alternate embodiment, a radially outward flange 28 proximate the front end 22 may be further disposed on the sleeve 20. Flange 28 is captured by an inner surface 42 of the nut 40 as the nut 40 is axially displaced toward the front end 32 of terminal 30. In this embodiment, the front end 22 of the sleeve 20 does not include the retaining lip 27. However, sleeve 20 may include both flange 28 and retaining lip 27 (not shown).

According to one embodiment of the present invention, a procedure for mounting the coaxial connector 10 to the end of the coaxial cable 60 includes the steps of inserting the nut 40 on the sleeve 20, removing a portion of the insulating jacket 62 from the end of the cable which is to be connected, thereby exposing an end portion of the outer conductor 64 of the coaxial cable 60; removing a portion of the outer conductor 64 and dielectric material 66 from the end of the cable 60 to be connected to expose an end portion of the inner or center conductor 68 thereof; inserting the prepared end of the cable 60 into the sleeve 20, and securing same, preferably by way of a compression fit; flaring the end of the outer conductor 64 of the coaxial cable radially outwardly; inserting the terminal 30 into the sleeve 20 such that the inner conductor 68 of the cable 60 is received in a bore of insulation 50 disposed within the terminal 30 and such that the flared end 65 of the outer conductor 64 is oriented in a gap formed between opposing contact surfaces 26 and 36 of the terminal 30 and sleeve 20 forming a clamping region, and, clamping the flared end 65 of the outer conductor 64 in place; and axially displacing the nut toward the front end of the terminal of the coaxial connector. Various retaining means, including but not limited to retaining lip 27 and complementary groove 37, and/or flange 28 and/or friction engagement between outer surface of terminal 30 and inner surface of sleeve 20 may be employed in accordance with the present invention.

As will be apparent to one having ordinary skill in the art, preparation of the cable 60 should include stripping a sufficient amount of material from the cable 60 to expose an adequate length of the inner conductor 68 for passage through the insulator 50 and connection with a coaxial port. In a preferred embodiment the exposed length of the inner conductor 68 is adequate to engage a female coaxial port to establish an electrical connection.

As will be apparent to one having ordinary skill in the art, nut 40 is adapted to securably engage sleeve 20 and terminal 30 when nut 40 is secured to a coaxial port.

In a preferred embodiment at least a portion of the inner conductor, preferably proximate the end 68 of said conductor, includes a highly conductive metal plating such as but not limited to gold, silver or platinum. The thickness of such plating is preferably in the range of from about 0.005 to about 0.012 mm.

In one set of embodiments, a coaxial connector is disclosed herein for attachment to a coaxial cable having an outer conductor and an inner conductor, the outer conductor of the coaxial cable having an outer diameter, the coaxial connector comprising: a sleeve having front and back opposing ends and a bore extending therethrough for allowing passage of the coaxial cable therethrough, at least a portion of the bore having an inner diameter commensurate with the outer diameter of the outer conductor of the coaxial cable, and a radially inward step having at least a first contact surface located between said front and back ends; a terminal having a bore, a stepped outer surface having a first outer diameter commensurate with an inner diameter of said sleeve, front and back opposing ends, the back end of the terminal including at least a second contact surface, the stepped outer surface forming a shoulder between the front and back ends; a nut having a bore extending therethrough for receiving the sleeve, the nut being axially displaceable along at least a portion of the sleeve; the front end of the sleeve securably attachable to the back end of the terminal, the front end of the sleeve extending around the back end of the terminal, wherein the first contact surface and second contact surface form a clamping region therebetween, said clamping region adapted to be tightened as the contact surfaces are urged toward each other; the coaxial connector not including a center conductor.

In some embodiments, said clamping region is adapted for clamping a portion of a cable conductor.

In some embodiments, a mechanical connection between said cable and said connector is established via said clamping region.

In some embodiments, said cable is either corrugated or smooth.

In some embodiments, the connector further comprises an insulator having a bore adapted to receive the inner conductor of the coaxial cable.

In some embodiments, the coaxial cable is about 0.54 inches in diameter.

In some embodiments, the sleeve comprises a radially inward retaining lip proximate said front end and the terminal comprising a retaining groove formed on the outer surface proximate the shoulder for receiving the radially inward retaining lip.

In some embodiments, the sleeve comprises a radially outward flange proximate the front end thereof.

In another set of embodiments, a method of attachment of a coaxial cable to a coaxial connector is disclosed herein, the coaxial cable having an inner conductor, an outer conductor, and an outer diameter, the method comprising the steps of: a) inserting an end portion of the cable through a sleeve of the connector; b) flaring an end portion of the outer conductor to form a flared portion of the outer conductor, the length of the flared portion being smaller than the outer diameter of the coaxial cable; c) attaching via a compression fit the cable and the sleeve to a terminal of the connector, the cable having been inserted through the sleeve, the terminal having an insulator formed in a bore of the terminal and the inner conductor extending through the insulator; and d) securing the end portion of the outer conductor between abutting surfaces of the terminal and the sleeve, the step of securing comprising axially displacing an annular nut toward a front end of the terminal. The method may further comprise the step of cleaning the end portion of the outer conductor.

In some embodiments, the cable has an insulating jacket, and the method further comprises the step of removing a portion of the insulating jacket from the end portion of the cable.

In some embodiments, the cable has a dielectric, and the method further comprises the step of displacing a portion of the dielectric from the end portion of the cable.

In some embodiments, the method further comprises the step of fastening the sleeve to the terminal.

In some embodiments, said step of flaring further comprises shaping the end portion of the outer conductor to correspond to an abutting surface of either the terminal or the sleeve, or a combination thereof.

In another set of embodiments, a coaxial connector for attachment to a coaxial cable is disclosed herein, the coaxial cable including an outer conductor, an inner conductor and an insulating jacket, the insulating jacket of the coaxial cable having an outer diameter, the coaxial connector comprising: a terminal having front and back opposing ends, the back end of the terminal including a first contact surface and at least one insulator having a bore for accommodating the passage therethrough of the inner conductor of the coaxial cable; a sleeve engagable to the back end of the terminal and extending around the back end of the terminal, the sleeve including a second contact surface, the sleeve including an internal bore extending therethrough for allowing passage of the coaxial cable, at least a portion of the internal bore having an internal diameter commensurate with the outer diameter of the insulating jacket of the coaxial cable; the first and second contact surfaces forming a gap therebetween for clamping a portion of the outer conductor of the coaxial cable therebetween, wherein the gap decreases as a nut extending around the sleeve and terminal is axially displaced toward a front end of the terminal.

In another set of embodiments, a method of attaching a coaxial connector to an end of a coaxial cable is disclosed herein, the coaxial connector comprising a sleeve having a front and back end and a radially inward step disposed between said ends, a terminal having a front and back end, a nut, at least one insulator, and a clamping region formed between opposing surfaces of the back end of the terminal and the radially inward step of the sleeve, the coaxial cable including an inner conductor, a dielectric surrounding the inner conductor, an outer conductor surrounding the dielectric, and a jacket surrounding the outer conductor, the jacket having an outer diameter, the outer conductor having opposing inner and outer surfaces, said method comprising the steps of: a. preparing the end of the coaxial cable by: i. removing a portion of the dielectric, outer conductor, and jacket from the inner conductor to expose a portion of the inner conductor extending beyond the end of the outer conductor; ii. removing a portion of the jacket from the outer conductor to expose a portion of the outer surface of the outer conductor; and iii. removing a portion of the dielectric from within the end of the outer conductor to expose a portion of the inner surface of the outer conductor; b. placing the nut on the sleeve; c. inserting the prepared end portion of the coaxial cable through the back end of the sleeve of the coaxial connector; d. flaring an end portion of the outer conductor to provide a flared portion; e. inserting the back end of the terminal into the front end of the sleeve such that the exposed inner conductor of the coaxial cable is oriented in a bore of the insulator oriented in a bore of the terminal; f. placing the flared portion of the outer conductor of the coaxial cable in close proximity to the clamping region of the coaxial connector; and g. securing the coaxial connector to the outer conductor of the coaxial cable in the clamping region.

In some embodiments, the step of securing the coaxial connector to the outer conductor includes the step of engaging a radially inward lip disposed proximate the front end of the sleeve with a groove disposed on the outer surface of the terminal.

In some embodiments, the nut includes a threaded surface, and the step of securing the coaxial connector to the outer conductor includes the step of engaging the threaded surface of the nut with a threaded surface of a coaxial port and rotating the nut relative to the port to tighten the nut onto the port.

In some embodiments, the sleeve comprises a radially outward flange, and said step of securing the coaxial connector to the outer conductor includes axially displacing the nut toward a front end of the terminal wherein an inner surface of the nut captures the radially outward flange of the sleeve.

In some embodiments, the sleeve further comprises at least one radial groove for accommodating an O-ring.

In another set of embodiments, a coaxial connector in combination with a coaxial cable is disclosed herein, the cable comprising an inner conductor disposed about a centerline and an outer conductor, the coaxial connector comprising: a sleeve comprising an inner surface and an outer surface, the inner surface defining a first bore adapted to receive the cable, the inner surface comprising a first contact surface; a terminal comprising an inner surface and an outer surface, the inner surface defining a second bore, the outer surface comprising a second contact surface; an insulator mounted within the second bore, the insulator comprising an inner surface and an outer surface, the inner surface of the insulator defining a third bore adapted to receive the inner conductor of the cable, wherein the outer surface of the insulator contacts the inner surface of the terminal, and wherein the inner conductor of the cable is disposed in the third bore and extends through the insulator; and a nut mounted around the outer surface of the sleeve; wherein at least a portion of the outer conductor is disposed between the first and second contact surfaces; and wherein no portion of the coaxial connector lies on the centerline.

In some embodiments, the first, second, and third bores are coaxial with the coaxial cable.

In some embodiments, the nut contacts the terminal. In some embodiments, the nut contacts the sleeve. In some embodiments, the nut contacts the terminal and the sleeve. In some embodiments, the nut is capable of axially sliding over at least a portion of the sleeve.

In some embodiments, the terminal and the sleeve are non-rotatably mounted to each other. In some embodiments, the terminal and the sleeve are compression fit together. In some embodiments, the terminal and the sleeve are press fit together. In some embodiments, the terminal and the sleeve are snap fit together.

In some embodiments, the insulator and the terminal are non-rotatably mounted to each other. In some embodiments, the insulator and the terminal are compression fit together. In some embodiments, the insulator and the terminal are press fit together. In some embodiments, the insulator and the terminal are snap fit together.

In some embodiments, the outer conductor is compressed between the first and second contact surfaces.

In another set of embodiments, a coaxial connector for use with a coaxial cable is disclosed herein, the cable comprising an inner conductor and an outer conductor, the coaxial connector comprising: a sleeve comprising an inner surface and an outer surface, the inner surface defining a first bore adapted to receive the cable, the inner surface comprising a first contact surface; a terminal comprising an inner surface and an outer surface, the inner surface defining a second bore, the outer surface comprising a second contact surface; an insulator mounted within the second bore, the insulator comprising an inner surface and an outer surface, the inner surface of the insulator defining a third bore adapted to receive the inner conductor of the cable, wherein the outer surface of the insulator contacts the inner surface of the terminal, and wherein the inner conductor of the cable is disposed in the third bore and extends through the insulator; and a nut mounted around the outer surface of the sleeve; wherein the sleeve, the terminal, the insulator, and the nut are concentrically disposed about a centerline; and wherein no portion of the coaxial connector lies on the centerline.

In some embodiments, the terminal and the sleeve are non-rotatably mounted to each other. In some embodiments, the terminal and the sleeve are compression fit together. In some embodiments, the terminal and the sleeve are press fit together. In some embodiments, the terminal and the sleeve are snap fit together.

In another set of embodiments, a hardline coaxial connector adapted to accommodate a coaxial cable having an outer diameter of between 0.52 and 0.56 inches is disclosed herein, the connector comprising a terminal containing an insulator adapted to accommodate the passage therethrough of an inner conductor of the coaxial cable for attaching said inner conductor to a port.

In some embodiments disclosed herein, a simple yet effective method of securely connecting a coaxial cable with either a corrugated (semi-rigid) or non-corrugated (rigid) outer conductor to a coaxial connector is provided.

In some embodiments disclosed herein, a coaxial connector which achieves both a secure electrical and mechanical attachment to both the outer conductor and inner conductor of the coaxial cable with a relatively small number of components is provided.

In some embodiments disclosed herein, a solderless coaxial connector is provided.

In some embodiments disclosed herein, a coaxial connector that does not itself include an inner or center conductor is provided, and instead the connector accommodates the inner conductor of the coaxial cable to be connected, minimizing the amount of loss from the cable end to the female interface and reducing the number of parts in the connector.

In some embodiments disclosed herein, a coaxial connector in which there is only a single contact between the connector and the cable is provided.

In some embodiments disclosed herein, a coaxial connector that requires only a single insulator in the connector is provided.

In some embodiments disclosed herein, front and back pieces, that do not require a hexagonal outer circumference or otherwise flat external surfaces for accommodating tools, are provided.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A coaxial connector for attachment to a coaxial cable having an outer conductor and an inner conductor, the outer conductor of the coaxial cable having an outer diameter, the coaxial connector comprising:

an insulator having a bore adapted to receive the inner conductor of the coaxial cable;

a sleeve having front and back opposing ends and a bore extending therethrough for allowing passage of the coaxial cable therethrough, at least a portion of the bore having an inner diameter commensurate with the outer diameter of the outer conductor of the coaxial cable, and at least a first contact surface located between said front and back ends;

a terminal having a bore, a stepped outer surface having a first outer diameter commensurate with an inner diameter of said sleeve, front and back opposing ends, the back end of the terminal including at least a second contact surface, the stepped outer surface forming a shoulder between the front and back ends;

a nut having a bore extending therethrough for receiving the sleeve, the nut being axially displaceable along at least a portion of the sleeve;

the front end of the sleeve securably attachable to the back end of the terminal, the front end of the sleeve extending around the back end of the terminal, wherein the first contact surface and second contact surface form a clamping region therebetween, said clamping region adapted to be tightened as the contact surfaces are urged toward each other;

wherein the sleeve surrounds the insulator; and wherein the coaxial connector is disposed about a centerline, and no portion of the coaxial connector lies on the centerline.

2. The connector of claim 1 wherein said clamping region is adapted for clamping a portion of a cable conductor.

3. The connector of claim 1 wherein a mechanical connection between said cable and said connector is established via said clamping region.

4. The connector of claim 1, the sleeve comprising a radially inward retaining lip proximate said front end and the terminal comprising a retaining groove formed on the outer surface proximate the shoulder for receiving the radially inward retaining lip.

5. The connector of claim 1, the sleeve comprising a radially outward flange proximate the front end thereof.

6. The connector of claim 1 wherein the nut surrounds the sleeve and the nut surrounds the terminal.

7. The connector of claim 1 wherein the nut contacts the sleeve and the nut contacts the terminal.

8. A coaxial connector in combination with a coaxial cable, the cable comprising an inner conductor disposed about a centerline and an outer conductor, the coaxial connector comprising:

a sleeve comprising an inner surface and an outer surface, the inner surface defining a first bore adapted to receive the cable, the inner surface comprising a first contact surface;

a terminal comprising an inner surface and an outer surface, the inner surface defining a second bore, the outer surface comprising a second contact surface;

an insulator mounted within the second bore, the insulator comprising an inner surface and an outer surface, the inner surface of the insulator defining a third bore adapted to receive the inner conductor of the cable, wherein the outer surface of the insulator contacts the inner surface of the terminal, and wherein the inner conductor of the cable is disposed in the third bore and extends through the insulator; and a nut mounted around the outer surface of the sleeve;

wherein at least a portion of the outer conductor is disposed between the first and second contact surfaces;

wherein the sleeve surrounds the insulator; and wherein no portion of the coaxial connector lies on the centerline.

9. The combination of claim 8 wherein the first, second, and third bores are coaxial with the coaxial cable.

10. The combination of claim 8 wherein the outer conductor is compressed between the first and second contact surfaces.

11. The connector of claim 8 wherein the nut surrounds the sleeve and the nut surrounds the terminal.

12. The connector of claim 8 wherein the nut contacts the sleeve and the nut contacts the terminal.

13. A coaxial connector for use with a coaxial cable, the cable comprising an inner conductor and an outer conductor, the coaxial connector comprising:

a sleeve comprising an inner surface and an outer surface, the inner surface defining a first bore adapted to receive the cable, the inner surface comprising a first contact surface;

a terminal comprising an inner surface and an outer surface, the inner surface defining a second bore, the outer surface comprising a second contact surface;

an insulator mounted within the second bore, the insulator comprising an inner surface and an outer surface, the inner surface of the insulator defining a third bore adapted to receive the inner conductor of the cable, wherein the outer surface of the insulator contacts the inner surface of the terminal, and wherein the inner conductor of the cable is disposed in the third bore and extends through the insulator; and a nut mounted around the outer surface of the sleeve;

wherein the sleeve, the terminal, the insulator, and the nut are concentrically disposed about a centerline, and the sleeve surrounds the insulator; and wherein no portion of the coaxial connector lies on the centerline.

14. The connector of claim 13 wherein the terminal and the sleeve are non-rotatably mounted to each other.

15. The connector of claim 13 wherein the terminal and the sleeve are compression fit together.

16. The connector of claim 13 wherein the nut surrounds the sleeve and the nut surrounds the terminal.

17. The connector of claim 13 wherein the nut contacts the sleeve and the nut contacts the terminal.

18. A hardline coaxial connector adapted to accommodate a coaxial cable having an outer diameter of between 0.52 and 0.56 inches, the connector comprising a sleeve having front and back opposing ends and a bore extending therethrough for allowing passage of the coaxial cable therethrough, a terminal containing an insulator adapted to accommodate the passage therethrough of an inner conductor of the coaxial cable for attaching said inner conductor to a port, wherein the sleeve surrounds the insulator, the front end of the sleeve securably attachable to a back end of the terminal with the sleeve having at least a first contact surface located between the front and back ends, the front end of the sleeve extending around the back end of the terminal, the back end of the terminal including at least a second contact surface, wherein the first contact surface and second contact surface form a clamping region therebetween, said clamping region adapted to be tightened as the contact surfaces are urged toward each other and wherein the coaxial connector is disposed about a centerline, and no portion of the coaxial connector lies on the centerline.

19. A coaxial connector for attachment to a coaxial cable having an outer conductor and an inner conductor, the outer conductor of the coaxial cable having an outer diameter, the coaxial connector comprising:

an insulator having a bore adapted to receive the inner conductor of the coaxial cable;

a sleeve having front and back opposing ends and a bore extending therethrough for allowing passage of the coaxial cable therethrough, at least a portion of the bore having an inner diameter commensurate with the outer diameter of the outer conductor of the coaxial cable, and at least a first contact surface located between said front and back ends;

a terminal having a bore, a stepped outer surface having a first outer diameter commensurate with an inner diameter of said sleeve, front and back opposing ends, the back end of the terminal including at least a second contact surface, the stepped outer surface forming a shoulder between the front and back ends;

a nut having a bore extending therethrough for receiving the sleeve, the nut being axially displaceable along at least a portion of the sleeve;

the front end of the sleeve securably attachable to the back end of the terminal, the front end of the sleeve extending around the back end of the terminal, wherein the first contact surface and second contact surface form a clamping region therebetween, said clamping region adapted to be tightened as the contact surfaces are urged toward each other;

wherein the nut contacts the sleeve, the nut contacts the terminal, and the sleeve surrounds the insulator; and wherein the coaxial connector is disposed about a centerline, and no portion of the coaxial connector lies on the centerline.

* * * * *